US007300339B2

(12) United States Patent
Gaul et al.

(10) Patent No.: US 7,300,339 B2
(45) Date of Patent: Nov. 27, 2007

(54) COVERING DEVICE

(75) Inventors: Hans-Dieter Gaul, Augsburg (DE); Peter Ostermeier, Diessen (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/582,470

(22) Filed: Oct. 16, 2006

(65) Prior Publication Data

US 2007/0093189 A1 Apr. 26, 2007

(30) Foreign Application Priority Data

Oct. 21, 2005 (DE) ..... 10 2005 000 143

(51) Int. Cl.
*B24B 55/04* (2006.01)

(52) U.S. Cl. ..... 451/451; 451/358

(58) Field of Classification Search ..... 451/451–457, 451/358; 83/440.2, 544–546, 814–819; 74/608–617
See application file for complete search history.

(56) References Cited

U.S. PATENT DOCUMENTS 6,375,557 B1 * 4/2002 Spangenberg et al. ..... 451/344
6,886,259 B2 * 5/2005 Kani ..... 30/376
7,131,897 B2 * 11/2006 Crover ..... 451/311

FOREIGN PATENT DOCUMENTS

DE 3815245 A1 11/1989

* cited by examiner

*Primary Examiner*—Dung Van Nguyen
(74) *Attorney, Agent, or Firm*—Abelman, Frayne & Schwab

(57) ABSTRACT

A covering device (2) for a power tool (4) for driving a circular working tool (6) includes a cover (8) for enclosing the circular working tool (6), a guide member (18) pivotally supported on the cover (8) for being placed onto the workpiece (28), a spring for biasing the guide member (18) in a first pivot direction (S1) away from the cover (8) and an adjustable depth stop (30) a locking device (38) for additionally adjustably securing the guide member (8) in a direction of the first pivot direction (S1).

5 Claims, 4 Drawing Sheets

COVERING DEVICE

BACKGROUND OF THE INVENTION

1. Field of the Invention

The present invention relates to a covering device for a power tool for driving a circular working tool such as, e.g., a power saw, furrow tool, or grinding tool and including a cover for enclosing the circular working tool. The covering device further includes a guide member pivotally supported on the cover for being placed onto the workpiece. The guide member is biased in a first pivot direction away from the cover by a spring. The covering device further includes an adjustable depth stop which provides for displacement of the guide member in a second pivot direction opposite the first pivot direction for placing the guide member onto the cover.

2. Description of the Prior Art

Covers of the type described above provide a particular good protection of the rotatable working tool during operation because the guide member is continuously pressed against the workpiece. Thereby, an almost complete covering of the rotatable working tool and, thus protection of the tool user from injury are insured. In addition, the interior of the covering device is reliably sealed from the surrounding environment, so that effective suction means can be connected with the covering device. The depth stop adjustably limits the pivotal movement of the guide member in the direction of the cover, which provides for setting of the maximal operational depth that corresponds to the maximal length of the projection of the working tool beyond the guide member.

German Publication DE 38 15 245 A1 discloses a safety device of a hand-held power tool with a guide slide provided on the protective cover. The guide slide is biased by a spring away from the cover. The guide slide is fixedly connected with a rail that projects through a housing part fixedly connected with the cover and is adjustably supported on the depth stop. When a predetermined depth of a cut is reached, the depth stop, which is displaced in a direction of the first direction, is placed onto the housing part. There is further provided a locking pawl that limits the pivotal movement of the guide slide in a second pivot direction opposite the first pivot direction.

With the known covering device, a maximal depth of the cut is set by positioning of the dept stop on the housing part in a direction of the second pivot direction of the guide slide. In addition, the locking pawl determines the maximal pivot angle in the direction of the first pivot direction.

The drawbacks of the known covering device consist in that the tool user should apply a constant pressure during operation to overcome the biasing force acting between the guide slide and the protective cover. If a satisfactory pressure force is not applied by the user, the biasing force presses the working tool against the workpiece, and a set cut or groove depth cannot be reached. Further, upon placement of the power tool onto the workpiece, the working tool cannot be seen, without using a hand for pivoting the guide slide, which substantially increases the danger of injury.

Accordingly, an object of the present invention is a covering device in which the above-discussed drawbacks of the prior art covering device are eliminated. Another object of the present invention is a covering device that would insure retaining of a set operational depth during operation.

SUMMARY OF THE INVENTION

These and other objects of the present invention, which will become apparent hereinafter, are achieved by providing a locking device for additionally adjustably secure the guide member relative to the cover in a direction of the first pivot direction and, thereby, in a direction opposite the direction the spring biasing force acts.

According to the present invention, the locking device provides for adjustment of the guide member, i.e., it provides for securing the guide member to the cover in different positions of the guide member relative to the cover. Thereby, it becomes possible to secure the guide member to the cover in a position that corresponds to the desired operational depth. With the inventive locking device, the power tool user needs not to overcome the biasing force acting between the guide member and the cover, but needs only to simply apply a satisfactory pressure to keep the guide member on the workpiece during operation. Thereby, it is possible to comfortably retain the set operational depth. In addition, it is possible to so secure the guide member to the cover in such a way that upon positioning of the power tool on the workpiece, the pertinent portion of the tool is clearly visible.

According to an advantageous embodiment of the present invention, the locking device automatically secures the guide member when the guide member reaches a position relative to the cover which corresponds to the set operational depth. Thereby, during the operation, the spring biases the guide member toward the workpiece until the guide member reaches a position relative to the cover which corresponds to the maximal operational depth, whereby a good protection and optimal suction conditions are achieved. As discussed above, upon the operational depth being attained, the guide member is automatically secured against the cover. The pressure force that the tool user needs to apply in order to keep the guide member on the workpiece is much smaller when the locking device is used. This is because the additional biasing force needs not to be compensated. In this way, the tool user can comfortably maintain the set operational depth.

Advantageously, the locking device has connection means provided on the depth stop and counter-connection means provided on the cover which form together an operational formlocking connection in the direction of the first pivot direction.

Because the connection means is provided on the depth stop, simultaneously with the setting of the desired working depth, the connection means is so positioned that it becomes connected with the counter-connection means when the working depth is reached, the connection means is automatically connected with the counter-connection means. In this way, a separate adjustment of the locking device is eliminated.

Preferably, the connection means and counter-connection means include at least one resiliently supported locking hook and a locking rim engageable from behind by the at least one resiliently supported locking hook. Thereby, the connection means and the counter-connection means can form a formlocking connection particularly easy and be easily separated from each other.

Advantageously, at least one locking hook is provided on the depth stop that also includes locking means for adjustably positioning of the depth stop on the guide member. The locking means engages counter-locking means provided on the guide member in an active position, and are biased together with the at least one locking hook, against a biasing force of a locking spring into a passive position. In the passive position, both the engagement of the locking means and the counter-locking means and the operational form-locking connection between the connection means and the counter-connection means are lifted off. Thereby, upon operating the depth stop, locking of both the depth stop and the locking device is simultaneously released in order to set a new working depth upon attaining of which, the guide member becomes connected with the cover. This permits to particularly comfortably set the working depth.

Advantageously, the locking spring is formed by a spring located between a bottom of the depth stop and an outer side of the guide member and which biases the depth stop away from the guide member into the active or locking position. Thereby, both the depth stop and the locking device can be brought into the passive position by applying pressure to the outer side of the depth stop, whereby the guide member is disconnected from the cover and/or a new setting of the working depth can be carried out. Advantageously, the locking spring is formed as one-piece with the depth stop, i.e., the locking spring is formed by a flexible region provided on the depth stop.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

Figure 1:
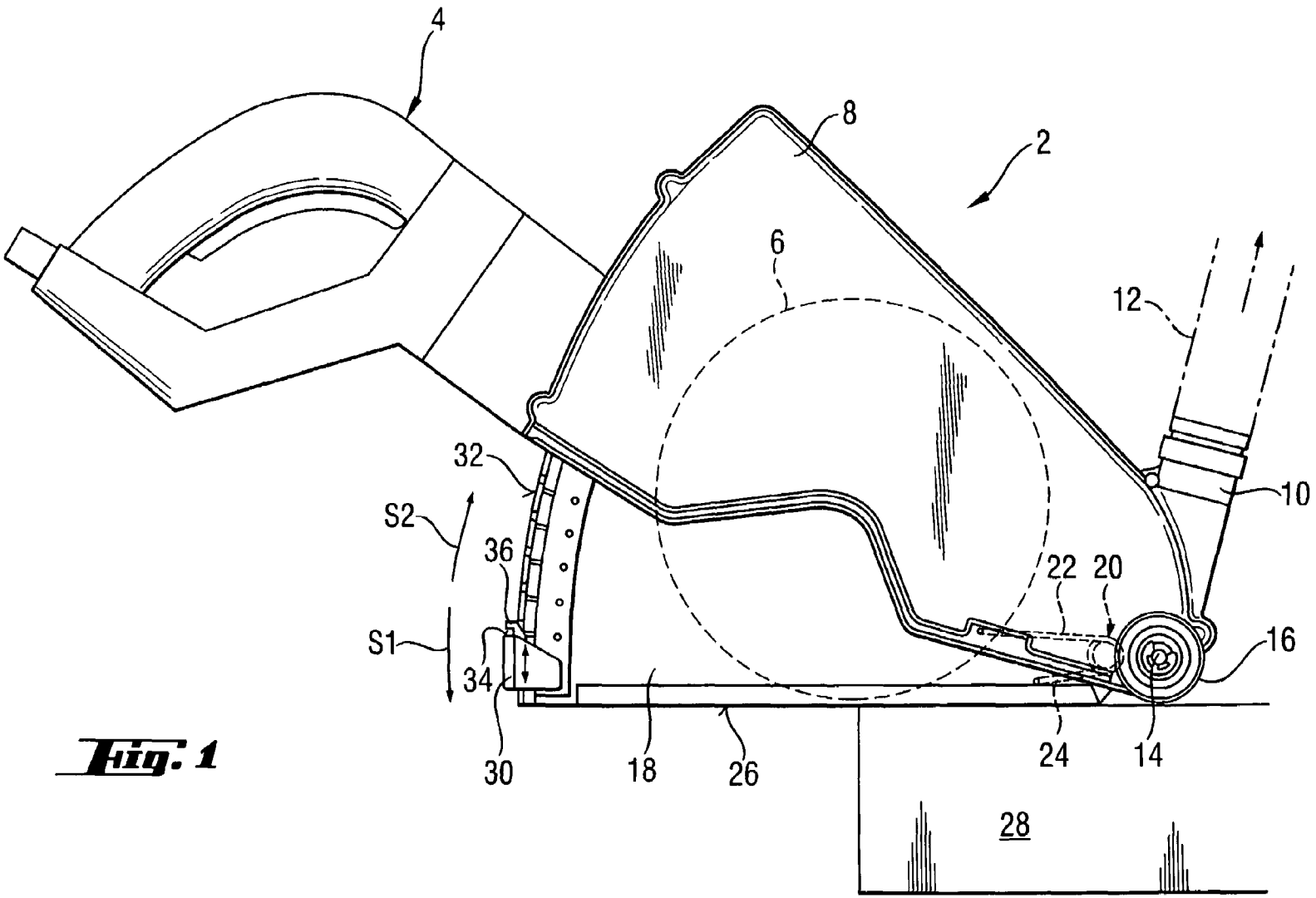
FIG. 1 a side view of a power tool with a covering device according to the present invention.

FIG. 1 shows a covering device 2 of a hand-held electrical power tool 4 in form of a combined cutting, slitting and grinding power tool for treating mineral workpieces and which drive a substantially circular working tool 6 in form of cutting or grinding disc or a slitting tool.

The covering device 2 includes a cover 8 which is secured on the power tool 4 and encloses the working tool 6. On the cover 8, there is provided a connection union 10 for connecting the cover 8 with dust suction means 12 that are not shown in detail. A guide member 18 is pivotally supported on the cover 8 by a pivot support that is formed by an axle 14 of a roller 16. The guide member 18 is preloaded in a first pivot direction S1 away from the cover 8 by a torsion spring 20. The torsion spring 20 engages with its first leg 22 the cover 8 and with its second leg 24 the guide member 18.

The guide member 18 has a bearing surface 26 that abuts, during operation of the power tool 4, a treated workpiece 28. On the guide member 18, there is provided a depth stop 30 that is displaceably supported on radial, with respect to the axle 16, outer side 32 of the guide member 18. The depth stop 30 forms a stop surface 34 that abuts the cover 8 in the second pivot direction S2 of the guide member 18 opposite the first pivot direction S1.

Figure 2:
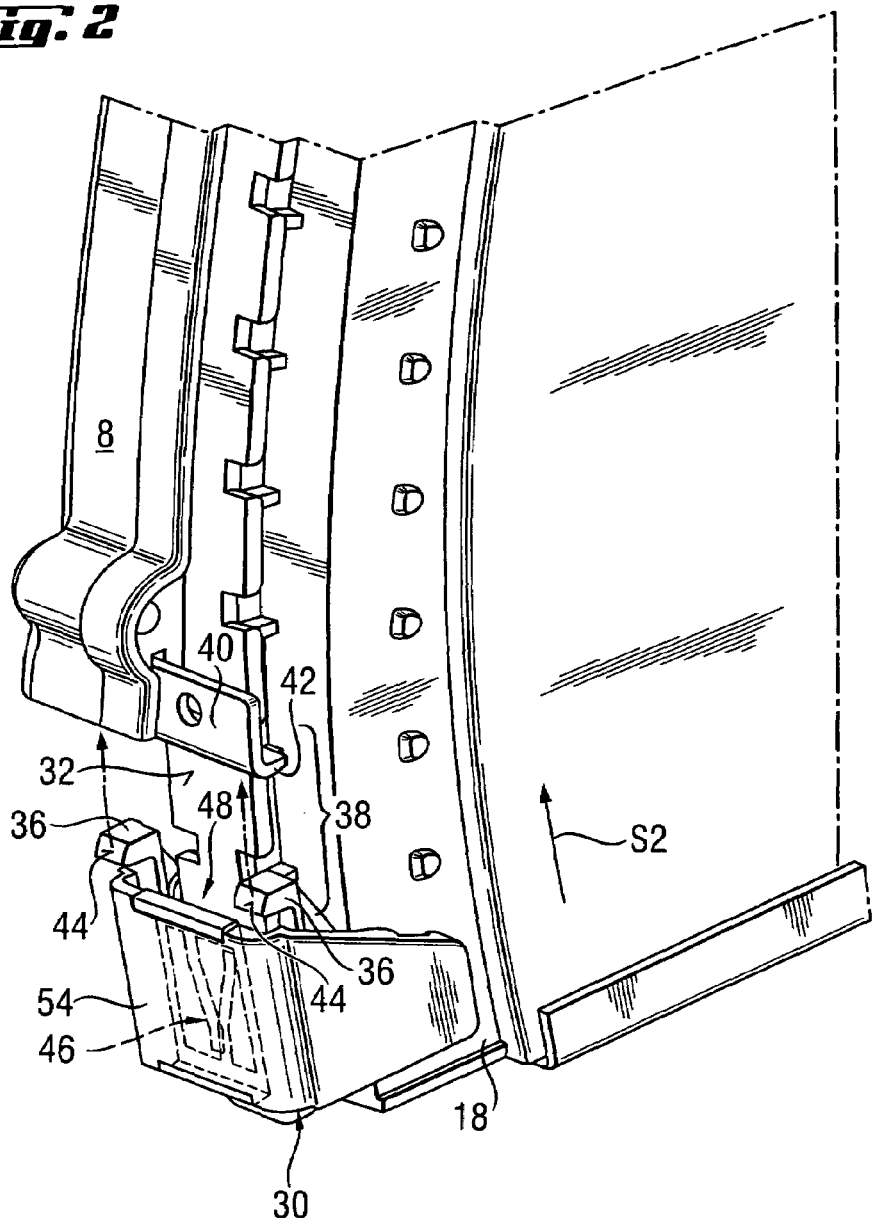
FIG. 2 a perspective view of a locking device and a depth stop of the covering device shown in FIG. 1, with a cover to its open position pivoted sidewise.

Further, connection elements 36 in form of locking hooks project from the depth stop 30 in the direction of the second pivot direction S2. The connection elements form part of a locking device 38 shown in detail in FIG. 2. For a better representation here, in FIG. 2, as in FIGS. 4-5, a side wall of the cover 8 is pivoted away.

The locking device 38 includes a shaped plate 40 mountable on the cover 8 and having a counter-connection element 42 in form of a locking rim. The connection elements 36 and the counter-connection element 42 are arranged on the guide member 18 or the cover 8 so that they automatically engage each other when the guide member 18 is displaced on the cover 8 in the second pivot direction S2.

The connection elements 36 have rounded impression surfaces 44 which press the depth stop 30 in the direction of the outer side 32 when the connection elements 36 engage the counter-connection elements 42. The pressure in the direction of the outer side 32 is applied against a biasing force of a locking spring 46 that is held on the bottom 48 of the depth stop 30 and is supported against the outer side 32.

Figure 3:
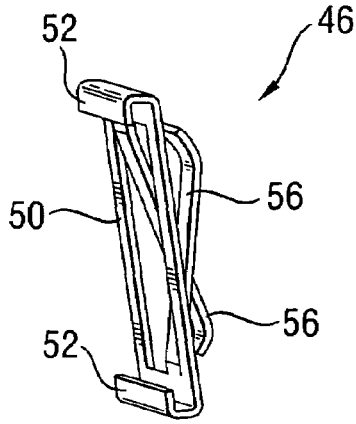
FIG. 3 a perspective view of a locking spring of the depth stop shown in FIG. 2.

The locking spring 46 has, as it is particularly shown in FIG. 3, opposite attachment elements 52 which are provided on the base body 50, for engaging from behind an upper side 54 of the depth stop 30. The locking spring 46 further has spring arms 56 that are pressed against the outer side 32 of the guide member 18. In this way, the locking spring 46 preloads the depth stop 30 away from the outer side 32. Thereby, in an unloaded condition of the depth stop 30, the bottom 48 of the depth stop 30 is spaced from the outer side 32 of the guide member 18. Alternatively to the embodiment shown in the drawings, according to which the locking spring 46 is formed as a separate element, the locking spring can be formed by a resilient region provided on the depth stop 30 and forming an integral part thereof.

Figure 4:
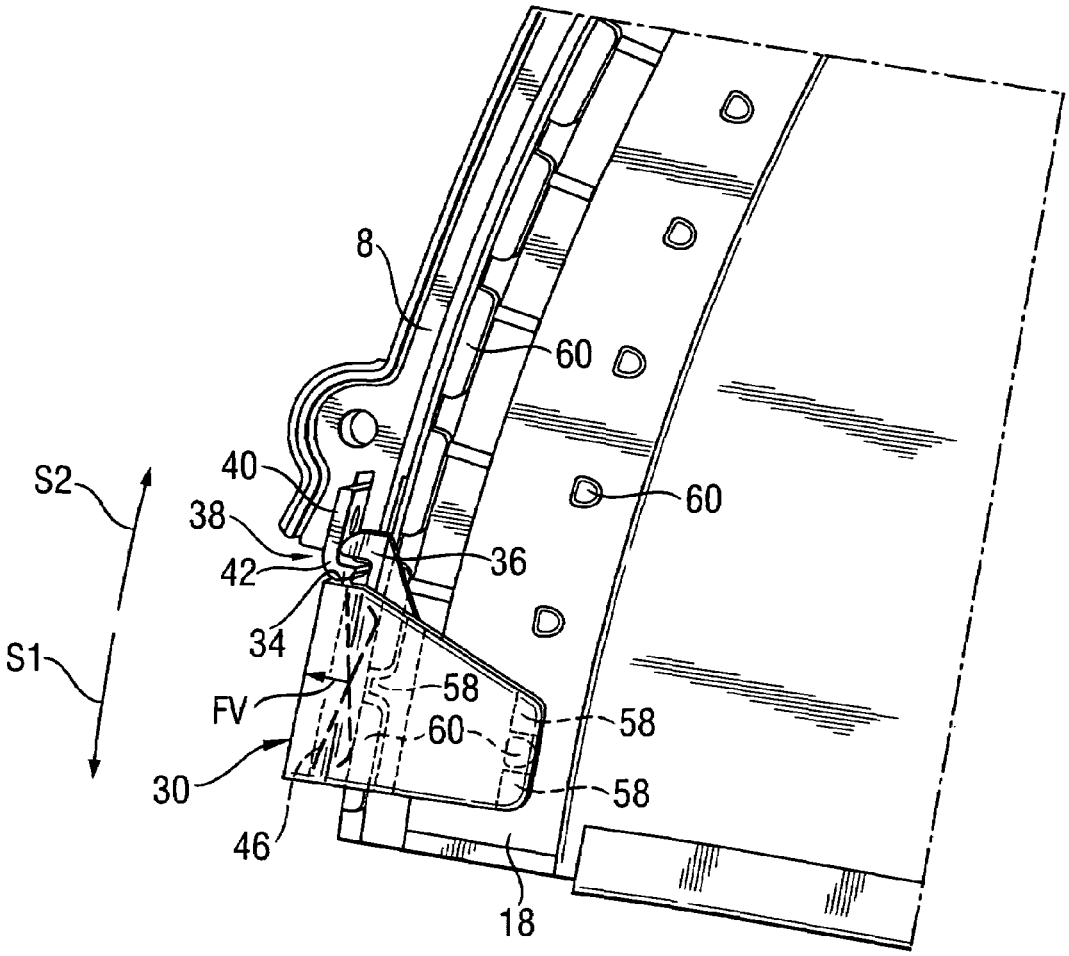
FIG. 4 a side view of the locking device and the depth stop shown in FIG. 2, with the cover pivoted sidewise to its open position in an active position.

As shown in FIG. 4, on the side of the depth stop 30 facing the guide member 18, there are formed locking means 58 in form of cams and ribs. These cams and ribs are preloaded by the biasing force FV of the locking spring 46 into an active position shown in FIG. 4 and in which they engage counter-locking elements 60 of the guide member 18 in form of cams and openings. In this way, the depth stop 30 is secured to the guide member 18.

In FIG. 4, the depth stop 30 has been displaced in the second pivot direction S2, and the stop surface 34 of the depth stop 30 abuts the shaped plate 40 that is mounted on the cover 8. Simultaneously, the connection elements 36 engage from behind the counter-element 42 of the shaped plate 40. In this way, the locking device 38 forms a form-locking connection between the cover 8 and the depth stop 30 and through the depth stop 30, with the guide member 18.

Figure 5:
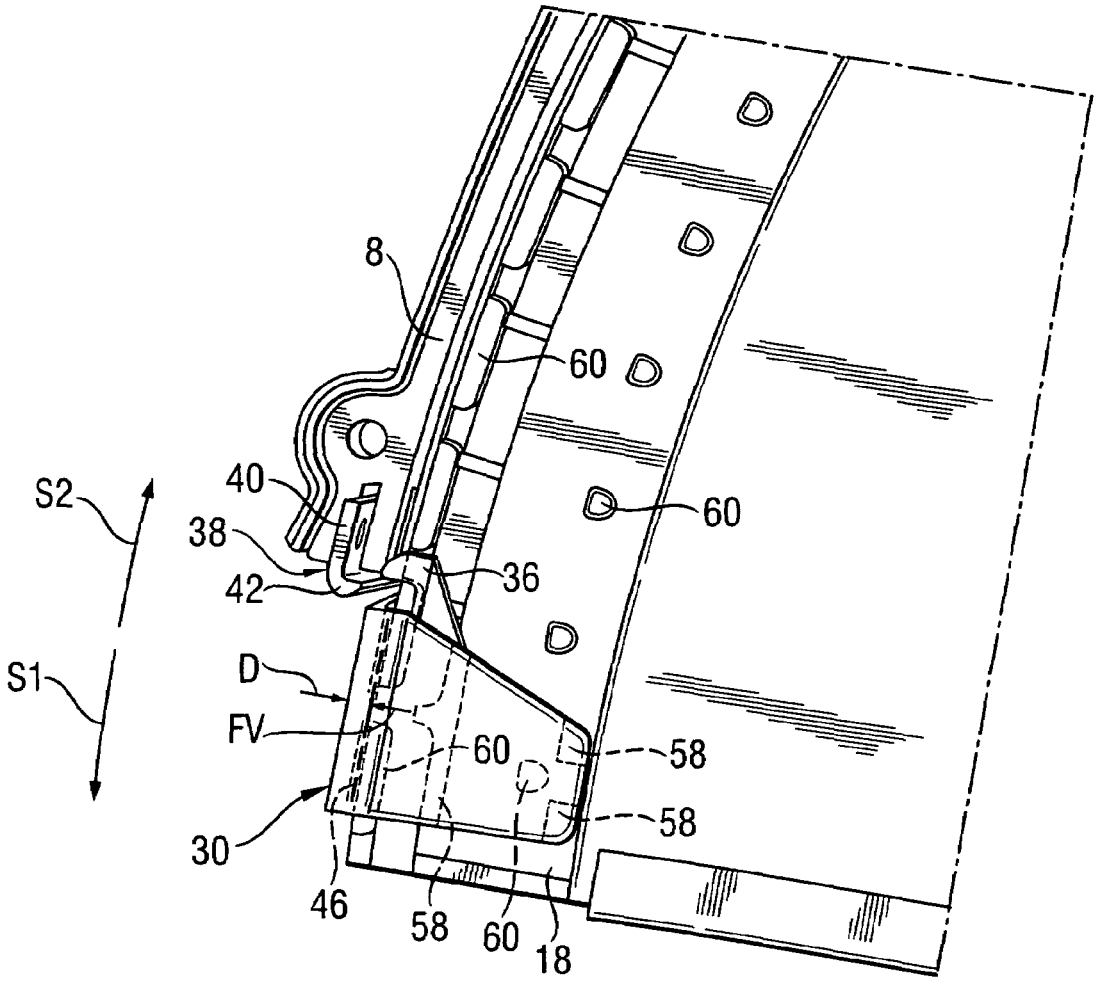
FIG. 5 a side view of the locking device and the depth stop shown in FIG. 2, with the cover pivoted sidewise to its open position, in a passive position.

As shown in FIG. 5, the locking means 58, together with the connection elements 36, can be displaced out of their engagement positions under application of pressure D generated by the biasing force FV of the locking spring 46, and into a passive position shown in FIG. 5. In the passive position of the depth stop 30, the formlocking connection, which is provided by the locking device 38, and the engagement of the locking means 58 with the counter-locking elements 60 are lifted off. In the passive position, the guide member 18 can again be pivoted relative to the cover 8. Further, in the passive position of the depth stop 30, the depth stop 30 can be displaced along the outer side 32 of the guide member 18 into another position in which its locking means 58, upon lifting off the pressure D, would engage new counter-locking elements 60.

Thus, before the start of an operation, the tool user, applying pressure D to the depth stop 30, can secure it in a desired position on the guide member 18. Dependent on this position, the guide member 18 is pivoted to a greater or lesser degree relative to the cover 8 in the direction of the second pivot direction S2. Thereby as a result, during an operation, the working tool 6 can project beyond the bearing surface 26 also to a greater or lesser degree. In this way, by positioning of the depth stop 30, a maximal cutting or slitting depth can be established.

Upon placing of the power tool 4 on the workpiece 28, the working tool 6, as shown in FIG. 1, is almost completely enclosed by the cover 8 and by the guide member 18 that has been pivoted to a maximal extent relative to the cover 8. Thereby, a reliable protection against a contact of the user with the working tool 6 is insured.

Upon working of the workpiece 28, the guide member 18 would only be pivoted in the second pivot direction S2 by the pressure force applied by the user until the depth stop 30 would lie on the cover 8, that is until maximal depth set by the depth stop 30 is reached. During the operation, the torque spring 20 biases the guide member 18 against the workpiece 28 and provides for a maximal cover of the rotatable working tool 6. Simultaneously, thereby, sealing of the covering device 2 from outside is provided, which insures also a high operational efficiency of the suction means 12.

As soon as the depth stop 30 stops against the cover 8, and the guide member 18 occupies a position relative to the cover 8 that corresponds to a maximal depth set by the depth stop, the connection elements 36 automatically snap behind the counter-connection element 42. Thereby, the guide member 18 is secured against rotation relative to the cover 8 in both the first pivot direction S1 and the second pivot direction S2, as shown in FIG. 4. Thus, the torque spring 20 does not apply any force to the covering device 2 that would have to be compensated by application of an additional pressure applied by the user. Therefore, the user, starting from establishment of the formlocking connection of the connection elements 36 with the counter-element 42, should only retain the bearing surface 26 on the workpiece 28 in order to reach the maximal depth.

In order to completely cover the working tool 6, e.g., at the end of an operational process, the user should simply provide for application of pressure D to the depth stop. As a result, the connection elements 36 are again disengaged from the counter-connection element 42, and the guide member 18 is again pivoted by the torque spring 20 in the direction of the first pivot direction S 1 and into the initial position shown in FIG. 1

Alternatively, to the above-described process, it is possible, already before the operation of the power tool 4, to secure the guide member 18 in a predetermined position relative to the cover 8 with the locking device 38. Thereby, it is achieved that the working tool 6 would project beyond the bearing surface 26 so far that it could clearly be seen and, thus, could be precisely placed on the workpiece 28 so that, e.g., during formation of a cut or a slot, no additional pressure should be applied from the start of the process.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A covering device (2) for a power tool (4) for driving a circular working tool (6), the covering device (2) comprising:

a cover (8), including counter-connection means (42), for enclosing the circular working tool (6);

a guide member (18) pivotally supported on the cover (8) for being placed onto the workpiece (28);

spring means for biasing the guide member (18) in a first pivot direction (S1) away from the cover (8);

an adjustable depth stop (30) including connection means (36), with the guide member (18) being displaceable in a second pivot direction (S2) opposite the first pivot direction (S1) to be placed onto the cover (8) via the depth stop (30); and a locking device (38) for additionally adjustably secure the guide member (18) relative to the cover (8) in a direction of the first pivot direction (S1), wherein the locking device (38) includes:

means for automatically securing the guide member (18) with respect to the cover (8) upon reaching a position of the guide member (18) relative to the cover (8) that corresponds to a set working depth, with the automatically securing means including:

the connection means (36) provided on the depth stop (30); and the counter-connection means (42) provided on the cover (8), with the connection means (36) and the counter-connection means (42) form together an operational formlocking connection in the direction of the first pivot direction (S1).

2. A covering device according to claim 1, wherein the connection means (36) and counter-connection means (42) comprise at least one resiliently supported locking hook and a locking rim engageable from behind by the at least one resiliently supported locking hook.

3. A covering device according to claim 2, wherein the at least one locking hook is provided on the depth stop (30) that includes locking means for adjustably positioning of the depth stop (30) on the guide member (18) and which engages counter-locking means (60) provided on the guide member (18) in an active position, and wherein the covering means (2) comprises a locking spring (46) for biasing the depth stop (30) into the active position, the locking means (58) being displaceable, together with the at least one locking hook, against a biasing force (FV) of the locking spring (46) into a passive position in which both engagement of the locking means (58) and the counter-locking means (60) and the operational formlocking connection between the connection means (36) and the counter-connection means (42) are lifted off.

4. A covering device according to claim 3, wherein the locking spring (46) is formed by a spring located between a bottom (48) of the depth stop (30) and an outer side (32) of the guide member (18) for biasing the depth stop (30) away from the guide member (18) into the locking position.

5. A covering device according to claim 3, wherein the locking spring is formed as one piece with the depth stop (30).

* * * * *